US008743140B2

(12) United States Patent
Dai et al.

(10) Patent No.: US 8,743,140 B2
(45) Date of Patent: Jun. 3, 2014

(54) COLOR ADJUSTMENT DEVICE, METHOD FOR ADJUSTING COLOR AND DISPLAY FOR THE SAME

(75) Inventors: Ye Dai, Shenzhen (CN); Chihtsung Kang, Shenzhen (CN)

(73) Assignee: Shenzhen China Star Optoelectronics Technology Co., Ltd., Guangdong (CN)

( * ) Notice: Subject to any disclaimer, the term of this patent is extended or adjusted under 35 U.S.C. 154(b) by 127 days.

(21) Appl. No.: 13/380,821

(22) PCT Filed: Dec. 19, 2011

(86) PCT No.: PCT/CN2011/084182

§ 371 (c)(1),
(2), (4) Date: Dec. 24, 2011

(87) PCT Pub. No.: WO2013/086745

PCT Pub. Date: Jun. 20, 2013

(65) Prior Publication Data

US 2013/0155091 A1 Jun. 20, 2013

(30) Foreign Application Priority Data

Dec. 15, 2011 (CN) ..... 2011 1 0419860

(51) Int. Cl.
*G09G 5/02* (2006.01)

(52) U.S. Cl.
USPC ..... 345/597; 345/589; 345/590; 345/591; 345/600; 345/604; 345/690

(58) Field of Classification Search
CPC ..... G09G 5/02; G09G 2320/0666; G09G 2340/06; G09G 2360/16; G06T 11/001
See application file for complete search history.

(56) References Cited

U.S. PATENT DOCUMENTS 7,755,640 B2 * 7/2010 Huang et al. ..... 345/600
8,305,396 B2 * 11/2012 Ahn et al. ..... 345/604

* cited by examiner

*Primary Examiner* — Antonio A Caschera

(57) ABSTRACT

The present invention provides a color adjustment device, a method of adjusting color and a display device for the same. It measures a plurality of tristimulus sets at various white grayscales on a LCD panel, converts the multiple tristimulus sets into a plurality of chromatic sets ($x_n$, $y_n$). Among the plurality of chromatic sets ($x_n$, $y_n$), it recognizes the $P_{th}$ chromatic set ($x_p$, $y_p$), the break point, and based on the $p_{th}$ chromatic set ($x_p$, $y_p$), determines a plurality of target chromatic sets ($Nx_n$, $Ny_n$) at from the grayscale 0 to the grayscale p, where $$Nx_n = x_0 + (x_{255} - x_0)\cdot\left[1 - \exp\left(1 - \frac{p}{n}\right)\right],$$

$$Ny_n = y_0 + (y_{255} - y_0)\cdot\left[1 - \exp\left(1 - \frac{p}{n}\right)\right].$$

By this method, an exponential function instead of a linear function is adopted to depict the chromatic variation at low grayscales. Thus the grayscale variation appears more smooth and without any obvious break point in human's perception.

9 Claims, 5 Drawing Sheets

COLOR ADJUSTMENT DEVICE, METHOD FOR ADJUSTING COLOR AND DISPLAY FOR THE SAME

BACKGROUND OF THE INVENTION

1. Field of the Invention

The present invention relates to a display device, more particularly to a color adjustment device, a method for adjusting color and a display for the same.

2. Description of the Prior Art

Based on a conventional image processing technology, a display area on a LCD panel is divided into multiple pixels, each of which comprises sub-pixels of displaying red, green and blue. Because all colors of visible light can be made by mixture of red, green and blue light, a required color shown in a pixel can be constructed by controlling luminance value of the red, green and blue sub-pixels.

To describe color more appropriately, the International Commission on Illumination, hereinafter referred to as the CIE, proposed the CIE 1931 XYZ color space, in which regard red, green and blue as three primary colors, and all other colors can be generated by mixture of the three primary colors. Two light sources, made up of different mixtures of various wavelengths, may appear to be the same color; this effect is called metamerism. Two light sources have the same apparent color to an observer when they have the same tristimulus values, no matter what spectral distributions of light were used to produce them. In this case, the two light sources have the same tristimulus values X, Y and Z which refer to proportions of the three primary colors. The CIE 1931 XYZ Space usually shows as the CIE 1931 chromaticity diagram, of which three parameters Y, x, y, where Y refers to luminance value, that is the stimulus value Y, while x and y refer to chromaticity values. In this case, $x=X/(X+Y+Z)$, $y=Y/(X+Y+Z)$, $z=Z/(X+Y+Z)$. Because $x+y+z=1$, z can be expressed in x and y.

When LCD panels display, color derivation probably occurs even if they are showing the white color at the same grayscale. In order to attain accuracy and consistency of colors on the LCD, it is necessary to perform white balance for each LCD. The method of white balance is as followed: At first, make pixels of the LCD show as white at all grayscales, and then adjust gain values of the strength of red, green and blue so that the chromatic values and the luminance value of the white performed on the LCD approaches a set of chromatic values and luminance value of a target white, that is, the white performed on the LCD is adjusted within a certain range of color temperature and color derivation.

Referring to FIG. 1, FIG. 1 shows a graph of relation between white and chromatic value in grayscale 0 to 255, according to the CIE 1931 XYZ color space, where $Wx_n$ and $Wy_n$ refer to the chromatic value x, y required to perform as white when grayscale n (n=0, 1, 2, 3 . . . 254, 255). FIG. 1 shows that the chromatic values x, y of various white at different grayscale in the CIE 1931 color space. For instance, at the grayscale 50, when $Wx_{50}=0.285$ and $Wy_{50}=0.295$, the pixel performs as white. In other words, by adjusting the grayscale applied to the RGB sub-pixels of the pixel so as to the chromatic value of RGB sub-pixels meet $Wx_{50}=0.285$ and $Wy_{50}=0.295$, the pixel is performing as white. Take FIG. 1 for example, at higher grayscales, e.g. grayscale 40 to 255, the ratio of the chromatic values x and y is a constant, that is, $Wx_{255}=Wx_n=0.285$ and $Wy_{255}=Wy_{50}=0.295$, n=40, 41, . . . , 255, while at lower grayscales, e.g. grayscale 1 to 40, the ratios of the chromatic values x and y are diverse.

In the dark state, the chromatic value performed on the panel usually drifts to blue. If it still remains the colorimetric as that of the grayscale 255, it is inevitable to increase proportions of red and green. As a result, the luminance increases while the contrast on the panel decreases at the dark state. Simultaneously, for human's sight, the variation of luminance brings in the chromatic variation. For human's sight, bluish dark state seems more real than the dark state in unchanged chroma does. Therefore, traditionally, the chromatic coordinate of the grayscale 0 is $(x_0, y_0)$ and the chromatic coordinate of the high grayscale, such as the grayscales greater than 32 in FIG. 1, is $(x_{255}, y_{255})$. The colorimetric coordinates of the grayscale 1-32 can be obtained by linear method:

$$x_n = x_0 + (x_{255} - x_0) \cdot \frac{n}{A},$$

$$y_n = y_0 + (y_{255} - y_0) \cdot \frac{n}{A},$$

$$(n \in [1, A])$$

Where $(x_n, y_n)$ is the chromatic coordinate of the grayscale n, A=32.

At the grayscale 32, however, discontinuity occurs in the chromatic variation, which causes chromatic inconsistency for human's sight. As a consequence, it becomes an object of the industry to develop a color adjustment device, a method for adjusting color and a display for the same, with a more decent colorimetric curve for human's sight, causing the grayscale variation seems more natural for human's eyes in the process of white balance.

SUMMARY OF THE INVENTION

Accordingly, the present invention has been made to provide a color adjustment device, a method of adjusting color and a display device for the same, with a more decent colorimetric curve for human's sight, causing the grayscale variation seems more natural for human's eyes in the process of white balance.

According to the present invention, a method of adjusting color comprises: measuring a plurality of tristimulus sets (WXn, WYn, WZn) at various white grayscales on a LCD panel; converting the plurality of tristimulus sets (WXn, WYn, WZn) into a plurality of chromatic sets $(x_n, y_n)$, where n=0, 1, 2, . . . , 255; among the plurality of chromatic sets $(x_n, y_n)$, judging a $p_{th}$ chromatic set $(x_p, y_p)$ as a break point, where $x_{p-1}-x_p<0$, $x_p-x_{p+1}=0$, $y_{p-1}-y_p<0$, $y_p-y_{p+1}=0$; and based on the $p_{th}$ chromatic set $(x_p, y_p)$, determining a plurality of target chromatic sets $(Nx_n, Ny_n)$ at from the grayscale 0 to the grayscale p, where $$Nx_n = x_0 + (x_{255} - x_0) \cdot \left[1 - \exp\left(1 - \frac{p}{n}\right)\right],$$

$$Ny_n = y_0 + (y_{255} - y_0) \cdot \left[1 - \exp\left(1 - \frac{p}{n}\right)\right],$$

n=0, 1, . . . , p and exp denotes to an exponential function.

In one aspect of the present invention, the method further comprises: based on the pth chromatic set $(x_p, y_p)$, determining a plurality of target chromatic sets $(Nx_n, Ny_n)$ at from the grayscale p+1 to the grayscale 255 as $(x_{255}, y_{255})$.

In another aspect of the present invention, the method further comprises:

converting the plurality of sets of target luminance value WYn and target chromatic values ($Nx_n$, $Ny_n$) into a plurality of target tristimulus sets, each grayscale corresponding to one of the target tristimulus set, and each target tristimulus set comprising three target stimulus values; determining a RGB ratios set corresponding to each of the target tristimulus set; and before the LCD panel showing a predetermined grayscale, adjusting the RGB ratios set at the predetermined grayscale on the basis of the RGB ratios set of the target tristimulus set corresponding to the predetermined grayscale.

In still another aspect of the present invention, the LCD panel comprises a plurality of pixels. Each pixel comprises a plurality of sub-pixels for displaying red, green and blue. The method further comprises: based on the RGB ratios of the target stimulus set corresponding to the predetermined grayscale, adjusting driving voltages applied to the plurality of sub-pixels of each pixel.

According to the present invention, a color adjusting device comprises: a measurement unit for measuring a plurality of tristimulus sets at various white grayscales on a LCD panel; a first conversion unit, connected to the measurement unit, for converting the plurality of tristimulus sets into a plurality of chromatic sets ($x_n$, $y_n$), n=0, 1, 2, . . . , 255; a judging unit, connected to the first conversion unit, for recognizing a $P_{th}$ chromatic set ($x_p$, $y_p$), that is, a break point, where $x_{p-1}-x_p<0$, $x_p-x_{p+1}=0$, $y_{p-1}-y_p<0$, $y_p-y_{p+1}=0$; a determining unit, connected to the judging unit, for determining a plurality of target chromatic sets ($Nx_n$, $Ny_n$) at from the grayscale 0 to the grayscale p, where $$Nx_n = x_0 + (x_{255} - x_0)\cdot\left[1 - \exp\left(1 - \frac{p}{n}\right)\right],$$

$$Ny_n = y_0 + (y_{255} - y_0)\cdot\left[1 - \exp\left(1 - \frac{p}{n}\right)\right],$$

n=0, 1, . . . , p, and exp refers to exponential function; a second conversion unit, connected to the determining unit, for converting the plurality of target chromatic sets ($Nx_n$, $Ny_n$) into a plurality of target tristimulus sets, each grayscale corresponding to one of the target tristimulus set, and each target stimulus set comprising three stimulus values; and a calculation unit, connected to the second conversion unit, for calculating a RGB ratios set corresponding to the tristimulus values of each target stimulus set.

In one aspect of the present invention, the color adjustment device further comprises a storage unit for storing all the RGB ratios sets corresponding to the target tristimulus sets produced by the calculation unit as a lookup table.

In another aspect of the present invention, the color adjustment device further comprises an adjustment unit, connected to the storage unit, for obtaining the RGB ratios set of the target tristimulus set corresponding to the predetermined grayscale from the lookup table, and accordingly adjusting the RGB ratios set at the predetermined grayscale, before the LCD panel showing a predetermined grayscale.

In still another aspect of the present invention, the determining unit, based on the pth chromatic set ($x_p$, $y_p$), determines a plurality of target chromatic sets ($Nx_n$, $Ny_n$) at from the grayscale p+1 to the grayscale 255 as ($x_{255}$, $y_{255}$).

In still another aspect of the present invention, a display comprises a liquid crystal display panel. The LCD panel comprises a plurality of pixels for displaying an image. Each pixel comprises a plurality of sub-pixels. The display further comprises the color adjustment device.

In still another aspect of the present invention, the display further comprises a driving unit coupled to the adjusting unit for adjusting driving voltage applied to the plurality of sub-pixels of each pixel according to the RGB ratios corresponding to the set of three target stimulus values at the predetermined grayscale.

In contrast to prior art, the color adjustment device, the method of adjusting color and the display device for the same, in the process of white balance, adopt exponential function instead of linear function to depict the chromatic variation at low grayscales. Thus the grayscale variation appears more smooth and without any obvious break point in human's perception.

These and other features, aspects and advantages of the present disclosure will become understood with reference to the following description, appended claims and accompanying figures.

DETAILED DESCRIPTION OF THE PREFERRED EMBODIMENTS

Figure 2:
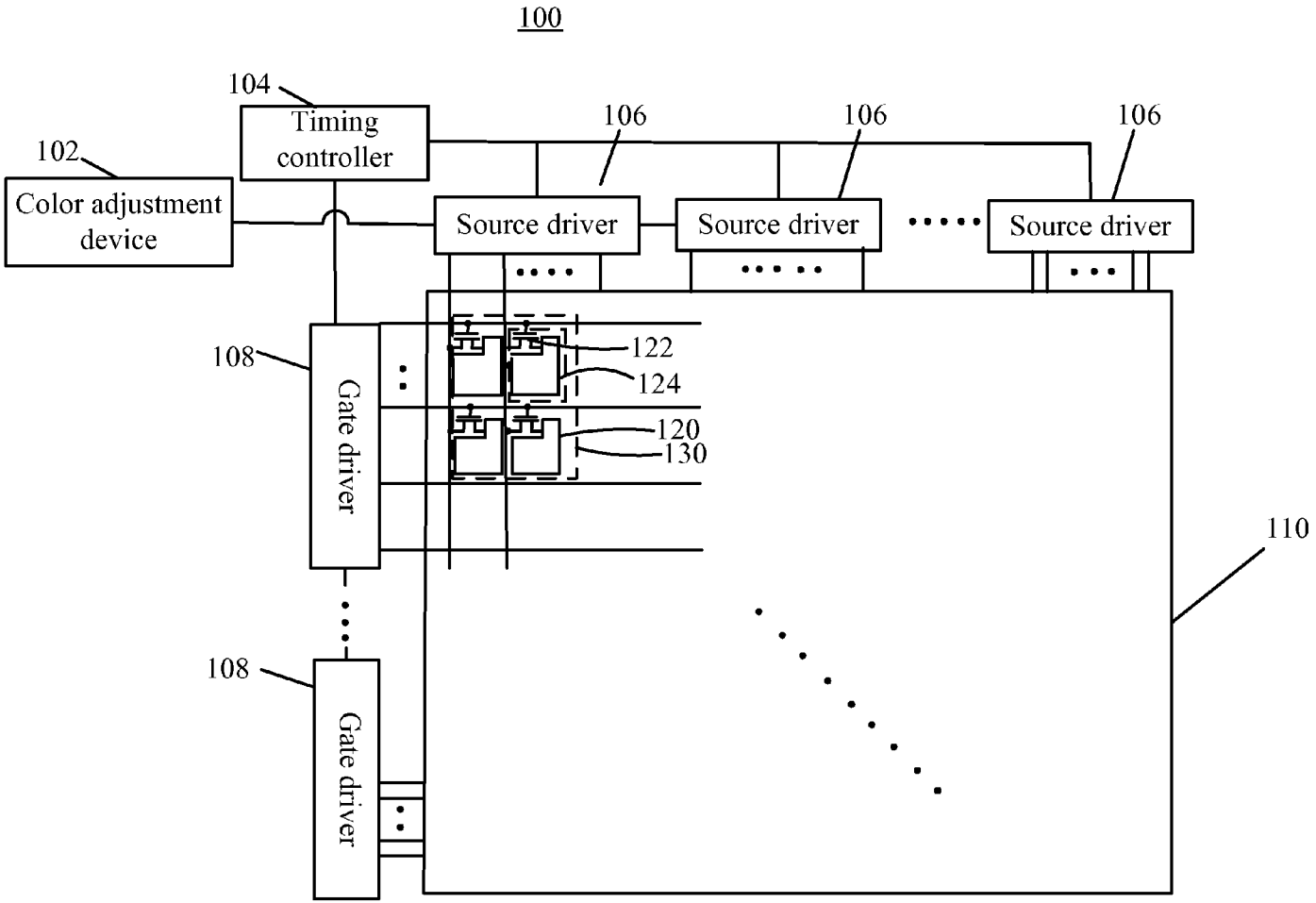
FIG. 2 depicts a schematic diagram of a display according to a preferred embodiment of the present invention.

Referring to FIG. 2, FIG. 2 depicts a schematic diagram of a display 100 according to a preferred embodiment of the present invention. The display 100 can be a device of a personal computer, a notebook, a digital camera, a digital camcorder, which comprises a LCD panel 110. The display 100 further comprises a timing controller 104, source drivers 106, a gate driver 108, and a color adjustment device 102. The LCD panel 110 comprises a plurality of pixels arranged in a matrix 130. Each pixel 130 comprises at least three sub-pixels 120 for displaying red, green, and blue (hereinafter referred to as RGB). When a vertical sync signal, generated by the timing controller 104, transmitted to the gate driver 108, the gate driver 108 subsequently produces a scan pulse to the LCD panel 110. Simultaneously, the timing controller 104 generates a horizontal sync signal to the source driver 106, and then the source driver 106 outputs grayscale voltage signal to the sub-pixel 120 of the LCD panel 110. Each sub-pixel 120 comprises a pixel electrode 124 and a thin-film transistor 122. A gate, source and drain of the thin-film transistor 122 respectively electrically connects to the gate driver 108, the source driver 106 and the pixel electrode 124 of the corresponding sub-pixel 120. The gate of the thin-film transistor 122 is turned on upon receiving a scan pulse transmitted from the gate driver 108. At then, a data voltage from the source driver 106 is applied to the pixel electrode 124. Alignment of liquid crystal molecules is adjusted based on the data voltage applied on the pixel electrode 124, and thus the alignment of the liquid crystal molecules decides the light transmittance of the pixel electrode 124. Because each pixel 130 is composed of a plurality of RGB sub-pixels 120, a color performed by each pixel 130 is determined by a proportion of light transmittance of the plurality of RGB sub-pixels 120.

Figure 3:
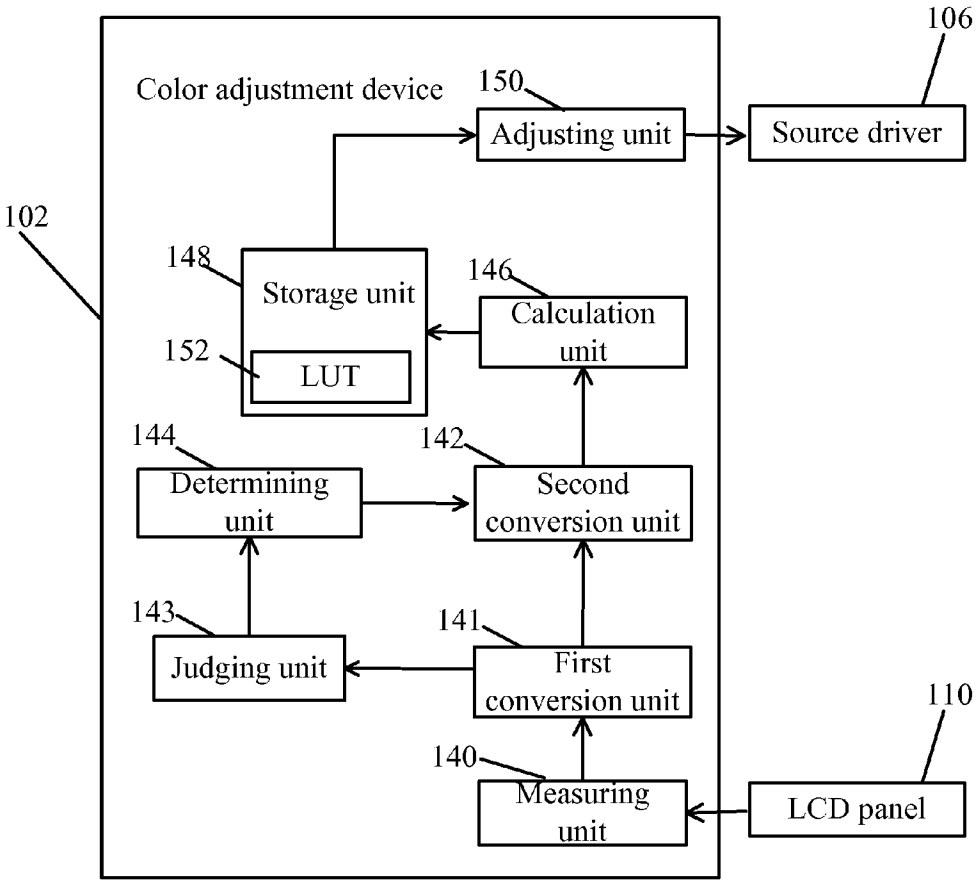
FIG. 3 shows a block diagram of a color adjustment device.

Referring to FIG. 3, the color adjustment device 102 comprises a measurement unit 140, a first conversion unit 141, a judging unit 143, a determining unit 144, a second conversion unit 142, a calculation unit 146, a storage unit 148 and an adjustment unit 150. The measurement unit 140 measures a plurality of tristimulus sets at various white grayscales on the LCD panel 110. The first conversion unit 141, connected to the measurement unit 140, converts the plurality of tristimulus sets into a plurality of chromatic sets (xn, yn), n=0, 1, 2, . . . , 255. The judging unit 143, connected to the first conversion unit 141, judges the $P_{th}$ chromatic set ($x_p$, $y_p$), at which is a break point, where $x_{p-1}-x_p<0$, $x_p-x_{p+1}=0$, $y_{p-1}-y_p<0$, $y_p-y_{p+1}=0$. The determining unit 144, connected to the judging unit 143, determines a plurality of target chromatic sets ($Nx_n$, $Ny_n$) at the grayscale n. When n=0, 1, . . . , p, $$Nx_n = x_0 + (x_{255} - x_0)\cdot\left[1 - \exp\left(1 - \frac{p}{n}\right)\right],$$

$$Ny_n = y_0 + (y_{255} - y_0)\cdot\left[1 - \exp\left(1 - \frac{p}{n}\right)\right],$$

where exp refers to an exponential function. When n=p+1, p+2, . . . , 255, $Nx_n=x_{255}$, $Ny_n=y_{255}$. The second conversion unit 142, connected to the determining unit 144, converts the plurality of sets of target luminance value $WY_n$ and target chromatic values ($Nx_n$, $Ny_n$) into a plurality of target tristimulus sets, where each grayscale corresponds to one of the target tristimulus set, and each target stimulus set comprises three stimulus values. The calculation unit 146, connected to the second conversion unit 142, calculates a RGB ratios set corresponding to the tristimulus values of each target stimulus set. The storage unit 148 stores as a lookup table (LUK) 152 of all the RGB ratios sets corresponding to the target tristimulus sets produced by the calculation unit 146. The adjustment unit 150, connected to the storage unit 148, before the LCD panel 110 showing a predetermined grayscale, obtains the RGB ratios set of the target tristimulus set corresponding to the predetermined grayscale from the lookup table 152, and accordingly adjusts the RGB ratios set at the predetermined grayscale. After then, the RGB ratios set is transmitted to the source driver 106.

Figure 4:
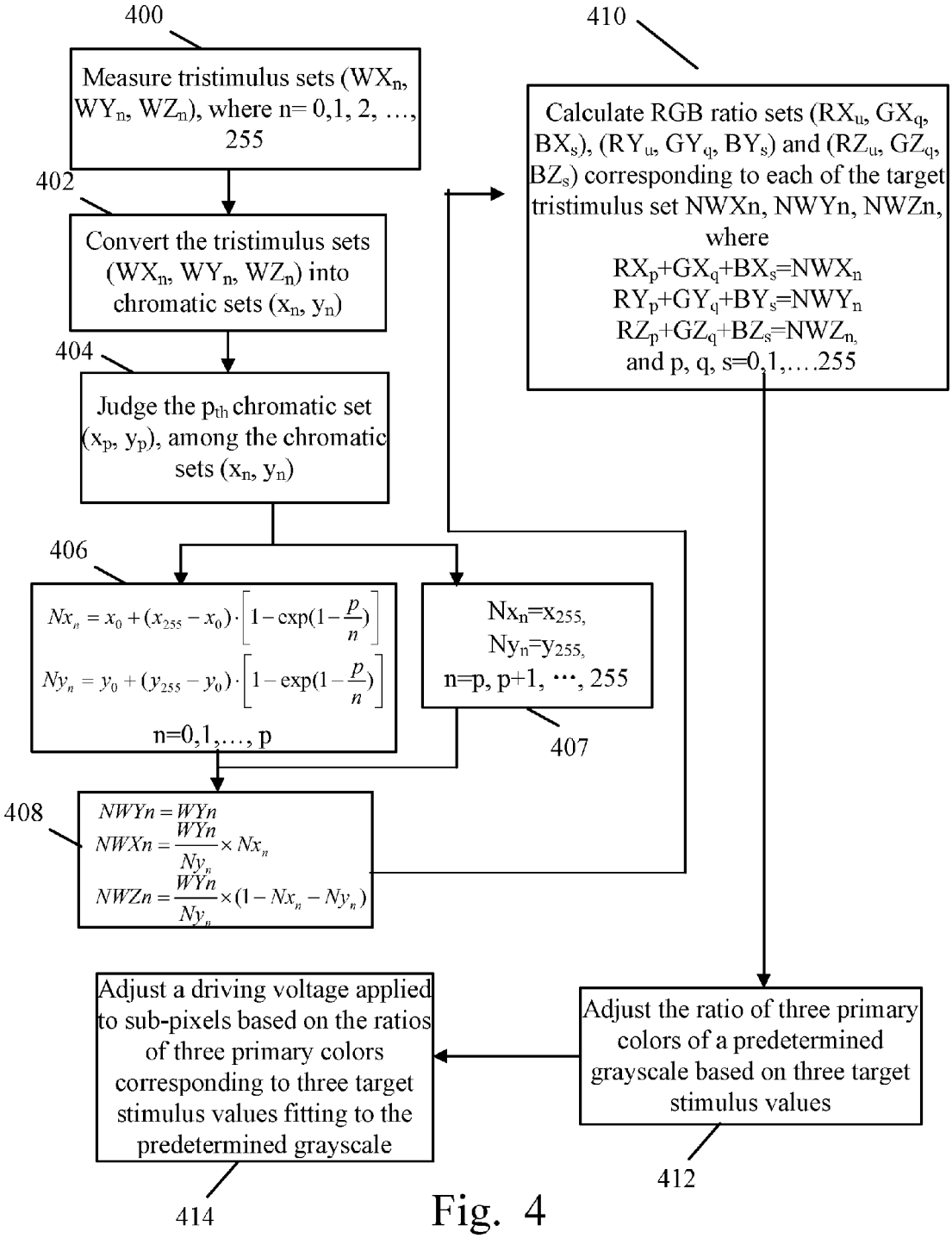
FIG. 4 depicts a flow chart of a method for adjusting color according to the present invention.

Referring to FIG. 4, FIG. 4 depicts a flow chart of the method for adjusting color according to the present invention. The method for adjusting color comprises following steps:

Step 400: measure a plurality of tristimulus sets ($WX_n$, $WY_n$, $WZ_n$) at various white grayscales (0-255) on the LCD panel 110, where n=0, 1, 2, . . . , 255.

Step 402: convert the plurality of tristimulus sets ($WX_n$, $WY_n$, $WZ_n$) into a plurality of chromatic sets ($x_n$, $y_n$), where n=0, 1, 2, . . . , 255.

Step 404: among the plurality of chromatic sets ($x_n$, $y_n$), judge the $P_{th}$ chromatic set ($x_p$, $y_p$), at which is a break point, where $x_{p-1}-x_p<0$, $x_p-x_{p+1}=0$, $y_{p-1}-y_p<0$, $y_p-y_{p+1}=0$.

Step 406: based on the $p_{th}$ chromatic set ($x_p$, $y_p$), determine a plurality of target chromatic sets ($Nx_n$, $Ny_n$) at from the grayscale 0 to the grayscale p.

$$Nx_n = x_0 + (x_{255} - x_0)\cdot\left[1 - \exp\left(1 - \frac{p}{n}\right)\right],$$

$$Ny_n = y_0 + (y_{255} - y_0)\cdot\left[1 - \exp\left(1 - \frac{p}{n}\right)\right],$$

where exp refers to an exponential function, n=0, 1, . . . , p.

Step 407: based on the $p_{th}$ chromatic set ($x_p$, $y_p$), determine a plurality of target chromatic sets ($Nx_n$, $Ny_n$) at from the grayscale p+1 to the grayscale 255, where $Nx_n=x_{255}$, $Ny_n=y_{255}$, n=p+1, p+2, . . . , 255.

Step 408: convert the multiple sets of target luminance value $WY_n$ and target chromatic values ($Nx_n$, $Ny_n$) into a plurality of target tristimulus sets (NWXn, NWYn, NWZn), where each grayscale corresponds to one of the target tristimulus set, and each target tristimulus set comprises three target stimulus values NWXn, NWYn and NWZn. NWXn refers to the target stimulus value X at the white grayscale n, NWYn to the target stimulus value Y at the white grayscale n, and NWZn to the target stimulus value Z at the white grayscale n.

Step 410: calculate a RGB ratios set ($RX_u$, $GX_q$, $BX_s$), ($RY_u$, $GY_q$, $BY_s$) and ($RZ_u$, $GZ_q$, $BZ_s$) corresponding to each of the target tristimulus set NWXn, NWYn, NWZn, where $NWXn=RX_u+GX_q+BX_s$, $NWYn=RY_u+GY_q+BY_s$, $NWZn=RZ_u+GZ_q+BZ_s$, u, q, s=0, 1, 2, . . . , 255. $RX_u$ refers to a stimulus value X of red at the u grayscale, $GX_q$ to a stimulus value X of green at the q grayscale, and $BX_s$ to a stimulus value X of blue at the s grayscale. So are the remaining parameters. Subsequently, integrate into a lookup table of all RGB ratios ($RX_u$, $GX_q$, $BX_s$), ($RY_u$, $GY_q$, $BY_s$) and ($RZ_u$, $GZ_q$, $BZ_s$) corresponding to each set of the three target stimulus values NWXn, NWYn, NWZn.

Step 412: before the LCD panel 110 showing a predetermined grayscale, obtains the RGB ratios set of the target tristimulus set corresponding to the predetermined grayscale, and accordingly adjust the RGB ratios set at the predetermined grayscale from the lookup table 152.

Step 414: based on the RGB ratios of the target stimulus set corresponding to the predetermined grayscale, adjust the driving voltage applied to each pixel.

Referring to FIG. 2 to FIG. 4, at first the all pixels 130 of the LCD panel 110 performs as white at the original multiple grayscales (0-255), and the measuring unit 140 measures the pixels 130 performing as white at from the grayscale 0 to the grayscale 255 and obtains a plurality of original RGB ratios of sub-pixels RGB 120, and, based on the plurality of original RGB ratios, determine a plurality of tristimulus sets (Step 400). The tristimulus values ($WX_n$, $WY_n$, $WZ_n$) are defined in the CIE1931XYZ color space.

After that, the first conversion unit 141 converts the tristimulus values ($WX_n$, $WY_n$, $WZ_n$) into a plurality of chromatic sets ($x_n$, $y_n$), n=0, 1, 2, . . . , 255 according to Equation 1 as followed (Step 402), $$x_n = WX_n/(WX_n+WY_n+WZ_n),$$

$$y_n = WY_n/(WX_n+WY_n+WZ_n) \qquad \text{Equation 1}$$

Figure 1:
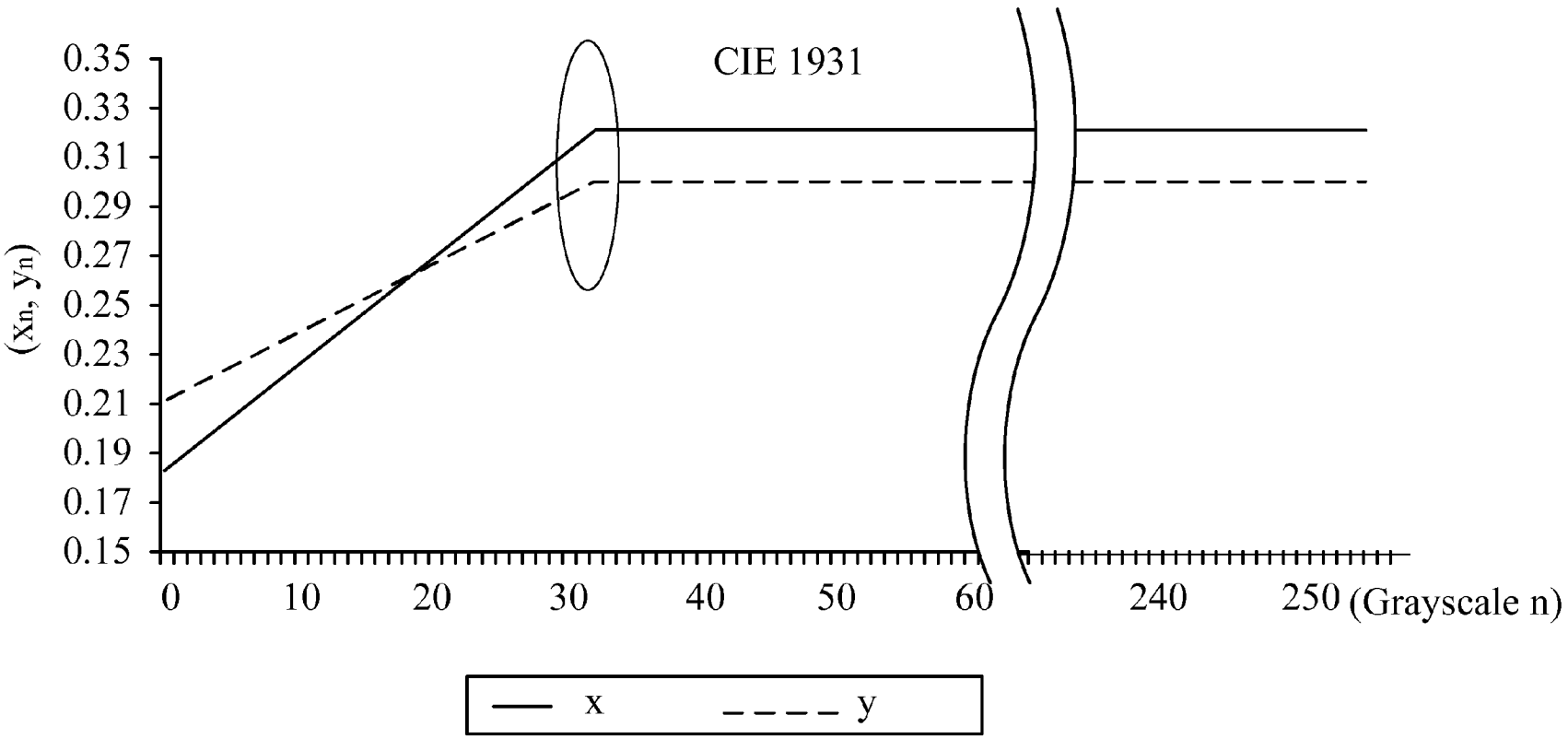
Fig. 1 (Prior art)
FIG. 1 shows a graph of relation between white and chromatic value in grayscale 0 to 255, according to the CIE 1931 XYZ color space.

At the step 404, because the chromatic values ($x_n$, $y_n$) tends to be a constant after a particular grayscale, such as the grayscale 32 in FIG. 1, the judging unit 143 figures out the particular $p_{th}$ chromatic set ($x_p$, $y_p$) at the particular grayscale p among the multiple chromatic sets ($x_n$, $y_n$). The $p_{th}$ chromatic set ($x_p$, $y_p$), the breakpoint, of each LCD panel 110 is various. In the embodiment, the judging unit 143 recognizes the $p_{th}$ chromatic set ($x_p$, $y_p$) by the Equation 2:

$$x_{p-1}-x_p<0, x_p-x_{p+1}=0,$$

$$y_{p-1}-y_p<0, y_p-y_{p+1}=0° \qquad \text{Equation 2}$$

At the step 406, the determining unit 144 substitutes the $p_{th}$ chromatic set ($x_p$, $y_p$) into the Equation 3, in order to determine the multiple target chromatic sets ($Nx_n$, $Ny_n$) at from the grayscale 0 to the grayscale p.

$$Nx_n = x_0 + (x_{255} - x_0)\cdot\left[1 - \exp\left(1 - \frac{p}{n}\right)\right], \qquad \text{Equation 3}$$

$$Ny_n = y_0 + (y_{255} - y_0)\cdot\left[1 - \exp\left(1 - \frac{p}{n}\right)\right],$$

where n=0, 1, . . . , p, exp refers to exponential function.

At the step 407, the calculation unit 144 simultaneously determines the plurality of target chromatic sets ($Nx_n$, $Ny_n$) at from the grayscale p+1 to the grayscale 255 equal to the constant ($x_{255}$, $y_{255}$).

Figure 5:
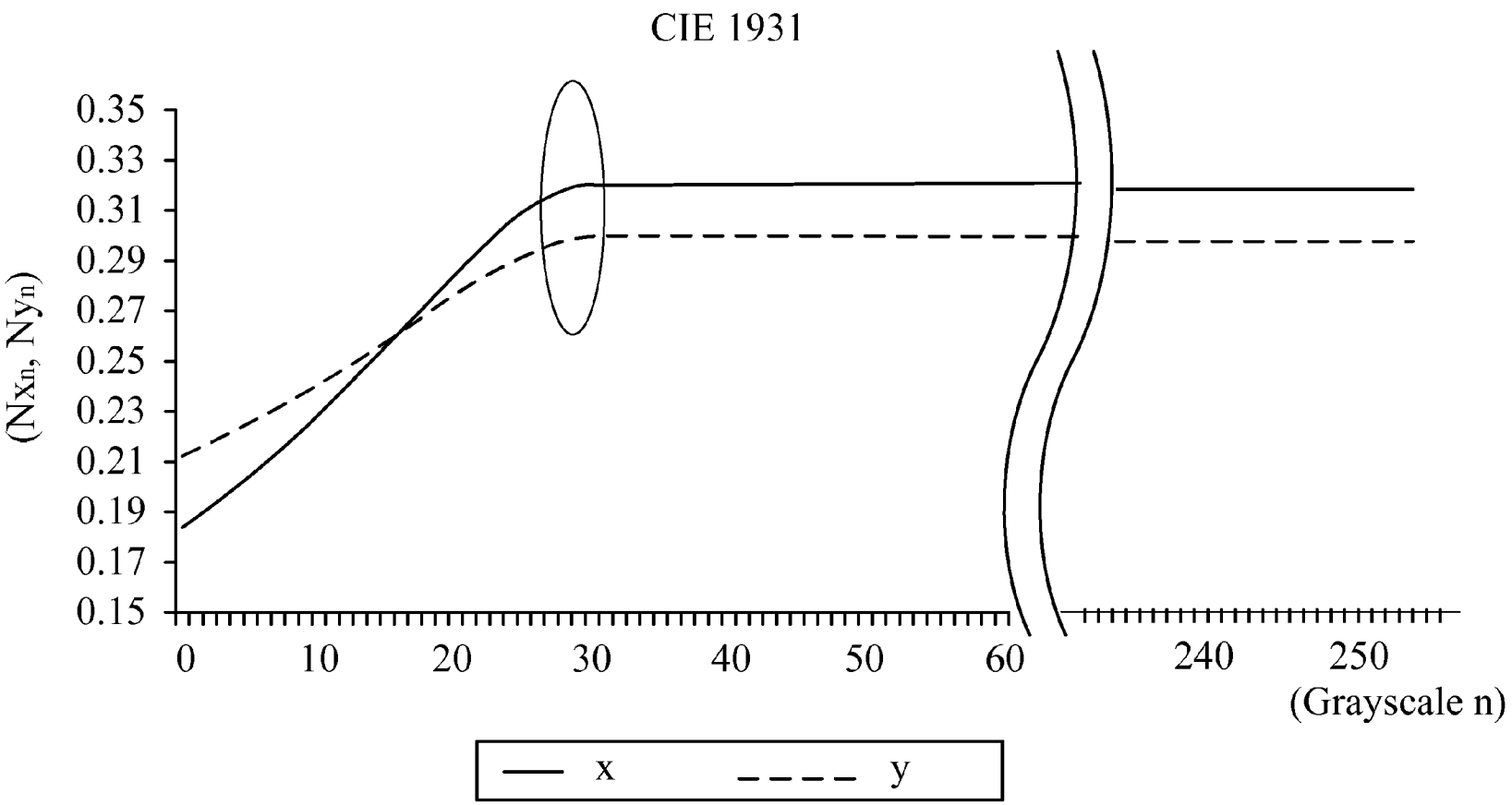
FIG. 5 shows a graph of relation between white and chromatic value in grayscale 0 to 255, produced by the determining unit, on the basis of the CIE 1931 XYZ color space.

Referring to FIG. 5, FIG. 5 shows a graph of relation between white and chromatic value in grayscale 0 to 255, produced by the determining unit 144, on the basis of the CIE 1931 XYZ color space. In contrast to FIG. 1, FIG. 5 depicts a smoother exponential curve without breakpoints of the target chromatic sets ($Nx_n$, $Ny_n$) at from the grayscale 1 to the grayscale p.

At step 408, the second conversion unit 142, by the Equation 4, converts the multiple sets of target luminance value WY and target chromatic values ($Nx_n$, $Ny_n$) into the plurality of target tristimulus sets (NWXn, NWYn, NWZn), where each grayscale corresponds to one of the target tristimulus set, and each target tristimulus set comprises three target stimulus values NWXn, NWYn and NWZn. NWXn refers to the target stimulus value X at the white grayscale n, NWYn to the target stimulus value Y at the white grayscale n, and NWZn to the target stimulus value Z at the white grayscale n, where $$NWYn = WYn,$$
$$NWXn = \frac{WYn}{Ny_n} \times Nx_n,$$
$$NWZn = \frac{WYn}{Ny_n} \times (1 - Nx_n - Ny_n). \qquad \text{Equation 4}$$

At the step 410, the calculation unit 146 calculates 256 sets of RGB ratios ($RX_u$, $GX_q$, $BX_s$), ($RY_u$, $GY_q$, $BY_s$) and ($RZ_u$, $GZ_q$, $BZ_s$) corresponding to 256 target tristimulus sets (NWXn, NWYn, NWZn), where $NWXn=RX_u+GX_q+BX_s$, $NWYn=RY_u+GY_q+BY_s$, $NWZn=RZ_u+GZ_q+BZ_s$, u, q, s=0, 1, 2, . . . , 255. $RX_u$ refers to a stimulus value X of red at the u grayscale, $GX_q$ to a stimulus value X of green at the q grayscale, and $BX_s$ to a stimulus value X of blue at the s grayscale. So are the remaining parameters. Subsequently, the calculation unit 146 integrates into the lookup table 152 of all RGB ratios ($RX_u$, $GX_q$, $BX_s$), ($RY_u$, $GY_q$, $BY_s$) and ($RZ_u$, $GZ_q$, $BZ_s$) corresponding to each set of the target tristimulus values NWXn, NWYn, NWZn, and stores them into the storage unit 148.

At the step 412, the adjustment unit 150, connected to the source driver 106, after receiving a predetermined grayscale, obtains the RGB ratios set of the target tristimulus set corresponding to the predetermined grayscale from the lookup table 152, and accordingly adjusts the RGB ratios set at the predetermined grayscale, and then transmits it to the source driver 106.

At the step 414, the source driver 106, based on the RGB ratios of the target stimulus set corresponding to the predetermined grayscale, adjusts the driving voltage applied to the plurality of sub-pixels 120 of each pixel 130.

When the display device 100 working and the pixel 130 performing as white at the grayscale 15, the adjustment unit 150 receives a signal of the grayscale 15, and subsequently finds out from the lookup table 152 the ratios of primary colors ($RX_u$, $GX_q$, $BX_s$), ($RY_u$, $GY_q$, $BY_s$) and ($RZ_u$, $GZ_q$, $BZ_s$) corresponding to the set of target stimulus values ($NWX_{15}$, $NWY_{15}$, $NWZ_{15}$), and accordingly transmits a compensation value out, whereby the sub-pixel of RGB 120 of the pixel 130 automatically adjusts the RGB ratios so as to perform the predetermined white.

In conclusion, the color adjustment device, the method of adjusting color, and the display device for the same distributes the lower chromatic values by exponential function in the process of white balance. As a result, the grayscale variation appears more smooth and without any obvious break point in human's perception.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A method of adjusting color for a display, characterized in that: the method comprises:

measuring a plurality of tristimulus sets at various white grayscales on a LCD panel by using the display;

converting the plurality of tristimulus sets into a plurality of chromatic sets ($x_n$, $y_n$) by using the display, where n=0, 1, 2, . . . , 255;

among the plurality of chromatic sets, judging a pth chromatic set ($x_p$, $y_p$) as a breakpoint, where $x_{p-1}-x_p<0$, $x_p-x_{p+1}=0$, $y_{p-1}-y_p<0$, $y_p-y_{p+1}=0$; and based on the pth chromatic set ($x_p$, $y_p$), determining a plurality of target chromatic sets ($Nx_n$, $Ny_n$) from the grayscale 0 to the grayscale p, where $$Nx_n = x_0 + (x_{255} - x_0) \cdot \left[1 - \exp\left(1 - \frac{p}{n}\right)\right],$$
$$Ny_n = y_0 + (y_{255} - y_0) \cdot \left[1 - \exp\left(1 - \frac{p}{n}\right)\right],$$

n=0, 1, . . . , p and exp denotes to an exponential function.

2. The method of claim 1, characterized in that: the method further comprises:

based on the pth chromatic set (xp, yp), determining a plurality of target chromatic sets (Nxn, Nyn) at from the grayscale p+1 to the grayscale 255 as (x255, y255) by using the display.

3. The method of claim 2, characterized in that: the method further comprises:

converting a plurality of sets of target luminance value WYn and target chromatic values (Nxn, Nyn) into a plurality of target tristimulus sets by using the display, each grayscale corresponding to one of the target tristimulus set, and each of the target tristimulus set comprising three target stimulus values;

determining an RGB ratios set corresponding to each of the target tristimulus set by using the display; and adjusting-RGB ratios set at the predetermined grayscale on the basis of the RGB ratios set of the target tristimulus set corresponding to the predetermined grayscale by using the display.

4. The method of adjusting color of claim 3, the LCD panel comprising a plurality of pixels, each pixel comprising a plurality of sub-pixels for displaying red, green and blue, characterized in that the method further comprises:

based on the RGB ratios of the target stimulus set corresponding to the predetermined grayscale, adjusting driving voltages applied to the plurality of sub-pixels of each pixel by using the display.

5. A display comprising a liquid crystal display (LCD) panel, the LCD panel comprising a plurality of pixels for displaying an image, each pixel comprising a plurality of sub-pixels, characterized in that: the display further comprises a color adjustment device, the color adjustment device comprising:

a measurement unit for measuring a plurality of tristimulus sets at various white grayscales on a LCD panel;

a first conversion unit, connected to the measurement unit, for converting the plurality of tristimulus sets into a plurality of chromatic sets ($x_n$, $y_n$), n=0, 1, 2, . . . , 255;

a judging unit, connected to the first conversion unit, for recognizing a pth chromatic set ($x_p$, $y_p$), that is, a break point, where $x_{p-1}-x_p<0$, $x_p-x_{p+1}=0$, $y_{p-1}-y_p<0$, $y_p-y_{p+1}=0$;

a determining unit, connected to the judging unit, for determining a plurality of target chromatic sets ($Nx_n$, $Ny_n$) at from the grayscale 0 to the grayscale p, where $$Nx_n = x_0 + (x_{255} - x_0)\cdot\left[1 - \exp\left(1 - \frac{p}{n}\right)\right],$$

$$Ny_n = y_0 + (y_{255} - y_0)\cdot\left[1 - \exp\left(1 - \frac{p}{n}\right)\right],$$

n=0, 1, . . . , p, and exp denotes to an exponential function;

a second conversion unit, connected to the determining unit, for converting the plurality of target chromatic sets ($Nx_n$, $Ny_n$) into a plurality of target tristimulus sets, each grayscale corresponding to one of the target tristimulus set, and each target stimulus set comprising three stimulus values; and a calculation unit, connected to the second conversion unit, for calculating an RGB ratios set corresponding to the tristimulus values of each target tristimulus set.

6. The display of claim 5, characterized in that: the color adjusting device further comprises a storage unit for storing all the RGB ratios corresponding to the white target tristimulus sets produced by the calculation unit as a lookup table.

7. The display of claim 6, characterized in that: the color adjusting device further comprises an adjusting unit, connected to the storage unit, for obtaining the RGB ratios set of the target tristimulus set corresponding to the predetermined grayscale from the lookup table, and accordingly adjusting the RGB ratios set at the predetermined grayscale.

8. The display of claim 7, characterized in that: the display further comprises a driving unit coupled to the adjusting unit for adjusting driving voltage applied to the plurality of sub-pixels of each pixel according to the RGB ratios corresponding to the set of three target stimulus values at the predetermined grayscale.

9. The display of claim 5, characterized in that: the determining unit, based on the pth chromatic set ($x_p$, $y_p$), determines a plurality of target chromatic sets ($Nx_n$, $Ny_n$) at from the grayscale p+1 to the grayscale 255 as ($x_{255}$, $y_{255}$).

* * * * *